US006533962B1

(12) United States Patent
Tulka et al.

(10) Patent No.: US 6,533,962 B1
(45) Date of Patent: Mar. 18, 2003

(54) ANTICORROSIVE PLASTIC PACKAGING MATERIALS

(75) Inventors: Jaromír Tulka, Brno (CZ); Eva Jančová , Brno (CZ); Jiří Sedlář , Brno (CZ); Jiří Pác, Brno (CZ)

(73) Assignees: Vojensky Technicky Ustav Ochrany (CZ); Polymer Institute Brno, Spol.S. R.O. (CZ)

( * ) Notice: Subject to any disclaimer, the term of this patent is extended or adjusted under 35 U.S.C. 154(b) by 0 days.

(21) Appl. No.: 09/831,619

(22) PCT Filed: Oct. 4, 1999

(86) PCT No.: PCT/CZ99/00033

§ 371 (c)(1),
(2), (4) Date: Jun. 15, 2001

(87) PCT Pub. No.: WO00/29641

PCT Pub. Date: May 25, 2000

(30) Foreign Application Priority Data

Nov. 13, 1998 (CZ) ..... 1998-3682

(51) Int. Cl.[7] ..... C09K 3/00

(52) U.S. Cl. ..... 252/389.1; 252/389.3; 252/394; 252/396; 428/34.1; 428/35.7; 428/35.8; 428/545

(58) Field of Search ..... 252/389.1, 389.3, 252/387, 394, 396; 428/34.1, 35.7, 35.8, 545

(56) References Cited

U.S. PATENT DOCUMENTS

| | | | | |
|---|---|---|---|---|
| 3,967,926 A | | 7/1976 | Rozenfeld et al. | |
| 4,275,835 A | | 6/1981 | Miksic et al. | |
| 4,290,912 A | | 9/1981 | Boerwinkle et al. | |
| 5,209,869 A | | 5/1993 | Miksic et al. | |
| 5,320,778 A | | 6/1994 | Miksic et al. | |
| 5,332,523 A | | 7/1994 | Igarashi et al. | |
| 5,332,525 A | | 7/1994 | Miksic et al. | |
| 5,393,457 A | | 2/1995 | Miksic et al. | |
| 5,422,187 A | | 6/1995 | Miksic et al. | |
| 5,683,751 A | * | 11/1997 | Derule | 427/384 |
| 5,840,381 A | * | 11/1998 | Ohtsuka | 428/34.4 |
| 6,033,599 A | * | 3/2000 | Lozano | 252/389.54 |
| 6,156,929 A | * | 12/2000 | Chandler | 562/582 |

FOREIGN PATENT DOCUMENTS

| | | | |
|---|---|---|---|
| CZ | 223373 | | 3/1986 |
| CZ | 284846 | * | 3/1999 |
| FR | 1508668 | | 1/1968 |
| FR | 1508668 | | 3/1968 |
| JP | 59-23884 | | 2/1984 |
| JP | 63-210285 | | 8/1988 |

* cited by examiner

*Primary Examiner*—Cephia D. Toomer
(74) *Attorney, Agent, or Firm*—Ostrolenk, Faber, Gerb & Soffen, LLP

(57) ABSTRACT

The anticorrosive plastic packaging materials for protecting iron, aluminum and alloys of these metals against corrosion comprise synergistic mixture of contact-vapour phase corrosion inhibitors containing salt or salts selected from the salts of ammonium and alkali metals or alkaline-earth metals derived from benzoic acid and for nitrous acid and 1,3-benzodiazole and for its 1-methyl derivative and 1H-benzotriazole and/or its methyl derivative and amorphous silicium oxide.

As the anticorrosive plastic packaging article are predominantly used films or packaging products made of film, containers, either of mono- or multi-layer construction, wherein in case of multilayer packaging articles the synergistic mixture of contact-vapour phase inhibitors is with advantage added to the layer or layers closer to the article to be protected.

4 Claims, No Drawings

ANTICORROSIVE PLASTIC PACKAGING MATERIALS

This application is a 371 of PCT/CZ99/00033 filed Oct. 4, 1999.

This invention relates to anticorrosive plastic packaging materials comprising synergistic mixture of contact-vapour phase corrosion inhibitors, which are suitable for protection of iron, aluminum and alloys of these metals against corrosion.

BACKGROUND OF THE INVENTION

Corrosion of articles made of iron, aluminum and alloys of these metals, non-ferrous metals etc. causes their functional and aesthetic devaluation. To diminsh or completely rule out these negative phenomena number of methods and means of protection against corrosion are employed, out of them the use of protective packaging materials containing metal corrosion inhibitors, predominantly plastics films, foams, containers etc. are the most important ones.

Most of the known plastic packaging materials comprising contact and/or vapour phase corrosion inhibitors exhibit sufficient inhibition efficiency but only for short term protection of steel surfaces (U.S. Pat. No. 3,967,926-1976, U.S. Pat. No. 4,290,912-1981). This is predominantly determined by the fact that the basic inhibiting component is, according to the above references, anion of nitrous acid or primary amine which are effective only in case of ferrous metals and the inhibition component is incorporated into the packaging material on a porous carrier. Moreover the prevailing part of known plastic packaging materials containing contact and/or vapour phase corrosion inhibitors comprise salts of nitrous acid (U.S. Pat. No. 5,332,523), particularly dicyclohexylamine nitrite (U.S. Pat. No. 5,422,187-1995, patent JP 63,210,285-1988, etc.) or organic salts of chromic acid, particularly cyclohexylamine chromate and dicyclohexylamine chromate (U.S. Pat. No. 4,275,835-1981), which can be industrially employed only to certain extent because of their missing hygienic approval. CS AO 223373 claims anticorrosion material containing mixture of inorganic benzoates with benzotriazole. The JP-A-59,023,884 describes a plastic anticorrosive material comprising a salt of benzotriazole or its derivatives and organic amine possibly complemented by a salt of a benzoic acid, its derivatives, or a fatty acid and an organic amine. Use of a sodium nitrite, sodium benzoate and benzotriazole is disclosed in FR-A-1508668 but for a paper impregnation.

When silica gel appears in some anticorrosion systems, it is usually employed as a desiccant or as a carrier of some anticorrosion inhibitors particularly of anhydrous molybdates (e.g. patents U.S. Pat. No. 5,332,525, U.S. Pat. No. 5,320,778, U.S. Pat. No. 5,209,869, U.S. Pat. No. 5,393,457). In U.S. Pat. No. 5,393,457 a plastic anticorrosive packaging material comprises besides anhydrous molybdate and silica gel also sodium nitrite and benzotriazole.

DESCRIPTION OF THE INVENTION

The effectiveness of contact-vapour phase inhibitors is determined not only by their suitable chemical structure but also by their vapour tension at the application temperature. To act as anticorrosive inhibitors they have to be at first evaporated and consequently condensed on the surface of the metal article to be protected. The protecting layer is very thin, even only monomolecular, therefore sufficient inhibitor vapour tension is usually in the range of $1{,}33\times10^{-1}$ to $1{,}33\times10^{-1}$ Pa at room temperature.

Anticorrosion inhibitors were originally used only in connection with anticorrosive packaging materials based on paper which was simply soaked with inhibitor solutions practically at room temperature, so the selection of suitable compounds was less limited.

This is different in case of plastic packaging materials, e.g. low density polyethylene film which is processed at temperatures above 160° C. Inhibitors have to be added to the material destined for production of anticorrosive plastic packaging material prior to its processing and therefore they are exposed to relatively high processing temperature and consequently partially lost either by evaporation or sublimation. Not only the loss of inhibitor but also emissions released cause difficulties during production and moreover increase also production cost. Quite a few inhibitors are not sufficiently compatible with particular plastic packaging material and exude to its surface. If the migration is too fast, the loss of inhibitor from the packaging material is also too fast and the inherent protection period shortens. Too fast inhibitors exudation also shortens storing period of finished packaging products or semi-finished articles destined for their production, worsen surface appearance and touch of packaging products.

We have observed that the system of the contact-vapour phase inhibitors comprising salts of benzoic acid and/or nitrous acid, 1,3-benzodiazole $C_7H_6N_2$ and/or its 1-methyl derivative, 1H-benzotriazole and/or its methyl derivative of the general formula

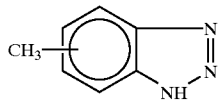

if it is combined with suitable grades of amorphous silicium oxide forms a synergistic mixture exhibiting higher anticorrosive protection, decreases formation of emissions during packaging article production, limits exudate formation on the packaging product surface and thus improves its appearance.

The mechanism of the observed synergy, as it is evident from the patent examples, is explained by the interaction of N-containing inhibitors with the surface of a selected silicium oxide grade.

The nature of anticorrosive plastics packaging materials suitable for protecting iron, aluminum and alloys of these metals against corrosion is based on the incorporation of the synergistic mixture of the contact-vapour phase inhibitors comprising 0,01–2,0 wt. % of the salt or the mixture of salts of benzoic acid and/or nitrous acid and 0,001–1,5 wt. % of 1,3-benzodiazole $C_7H_6N_2$ and/or its 1-methyl derivative and 0,001–1,0 wt. % of 1H-benzotriazole $C_6H_5N_3$ and/or its methyl derivative of the general formula

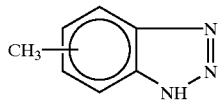

and 0,01–4,0 wt. % of amorphous silicium oxide $SiO_2$.

By the salt or mixture of salts of benzoic acid and/or nitrous acid is according to this invention understood the salts or the mixture of salts of alkali metals, the salts of alkaline-earth metals and/or the salts or the mixture of ammonium salts.

By the plastic packaging product it is according to this invention understood film or packaging products made out of the film (sacks, bags, etc.), then injection or blow molded packaging products such as bottles, boxes, containers etc., made out of the anticorrosive plastic packaging material.

By the plastic packaging material it is according to this invention understood polyethylene and copolymers of ethylene with higher alpha olefins in the density range of 860–967 kg/m$^3$, copolymers of ethylene comprising 0,5–40 wt. % of vinylacetate or $C_1$–$C_4$ alkylesters of acrylic or methacrylic acid, polypropylene, copolymers of propylene with ethylene and/or with higher $C_4$–$C_8$ alpha olefines having comonomer content 0,1–10 wt. %. The plastic packaging material may also be composed of the mixture of hereinbefore stated polymers.

The salts or the mixture of salts of benzoic and/or nitrous acid which do not melt at the polymer processing temperature are employed as ground materials having maximum particle size corresponding to ⅓ of the plastic packaging product wall thickness. The particle size lower than 10 micrometers usually meets the requirements of all the above mentioned applications.

Preferably, the anticorrosive plastic packaging materials of the invention are in the form of films or packaging products made of film or containers and/or porous emittors which are placed together with the article to be protected into another packaging product.

By the synergistic component of the system related to the present invention is constituted by the amorphous silicium oxide having mean particle size 1–20 micrometers the actual particle size is selected with respect to the packaging product wall thickness, and having pore volume in the range of 0,4–2,5 ml/g and pH value of 5% water suspension between 4,0 and 8,0.

For the given system the $SiO_2$ grades having pore volumes between 1,2 and 1,8 ml/g and pH values of 5% water solution in the range of 5,0–8,0 (DIN ISO 787-9) are the most suitable.

All components are added to the material selected for the production of the plastic packaging product as dry homogenised mixtures or dry mixtures comprising polymer fluff However the most suitable application form is pelletised masterbatch of all components in the same type of polymer as it is used for plastic packaging product or in the polymer compatible with it.

Another possibility is to add mixture of pelletised masterbatch of all organic components and pelletised $SiO_2$ masterbatch in polymers compatible with the plastic packaging material.

All above described procedures, providing that good homogeneity of all components in the packaging material is secured, guarantee that the packaging article will exhibit the same properties.

In case that multilayer packaging product is produced it is advantageous to add all components into the inner or middle layer by the procedures described earlier.

The basic advantages of the present synergistic system when compared with the use of the masterbatch of mixed metal anticorrosion inhibitors according to Czech application PV 1462-97v are the following: increased anticorrosive efficiency, decreased emissions during production, particularly of large surface area articles such as films, decreased exudation of additives to the article surface and consequently improved surface appearance and prolonged storage period of semi-final or final articles.

EXAMPLES OF INVENTION EXECUTION

The following examples illustrate the nature of the present invention:

Example 1

From the mixture comprising 10 wt. % of sodium benzoate having particle size lower than 10 micrometers, 4,8 wt. % of 1-methyl-1,3-benzodiazole, 1,2 wt. % of 1H-benzotriazole and 84 wt. % of low density polyethylene having melt flow index 19,6 g/10 min at 190° C. and the load of 21,2 N (CSN 640861) was with the use of a twin-screw extruder W&P ZSK 40, pelletised masterbatch A1.

From the mixture containing 8,00 wt. % of sodium benzoate having particle size lower than 10 micrometers, 3,84 wt. % of 1-methyl-1,3-berizodiazole, 0,96 wt. % of 1H-benzotriazole, 15,00 wt. % of amorphous silicium oxide having pore volume 1,2 ml/g and mean particle size 4 micrometers, pH value of 5% water suspension 4,5 and 72,20 wt. % of the same low density polyethylene as in case of the A1 masterbatch preparation, was in the same way prepared pelletised masterbatch denoted as B1.

Each of the two masterbatches was in the let down ratio of 4 wt. % mixed with low density polyethylene having melt flow index 0,8 g/10 min and from both mixtures at the melt temperature 165° C. were prepared 100 micrometers thick tubular blown films, which were in accord with the corresponding masterbatches denoted as AIF and BIF. Both films were analysed to determine the content of individual inhibitors. The table below shows the loss of individual components expressed in wt. % of the original concentration prior to processing:

| | A 1 F | B 1 F |
|---|---|---|
| Sodium benzoate | 3.0 | 2.0 |
| 1-Methyl-1,3-benzodiazole | 45.0 | 15.0 |
| 1H-Benzotriazole | 57.0 | 23.0 |

Steel test specimens according to ČSN 411321 and aluminum ones according to ČSN 424105, all with polished surface, were wrapped into prepared films AIF, BIF and into the film without any anticorrosive inhibitors (film CIF) prepared from the same basic polymer processed by the previously described procedure. All three films had the same thickness 100 micrometers. After all film joints were made watertight, the wrapped test specimens were tested according to DIN 50017, KFW method (1 cycle-8 hours at 40° C. and 100% relative humidity; 16 hours at 23° C. and <75% relative humidity). The following table summarises the test results—the number of cycles before first signs of corrosion appeared—rust in case of steel and surface darkening of aluminum.

| | Film A 1 F Number of cycles | Film B 1 F Number of Cycles | Film C 1 F Number of cycles |
|---|---|---|---|
| Fe | 163 | >210 | 13 |
| Al | 135 | 150 | 10 |

Example 2

From the mixture containing 5,0 wt. % of sodium benzoate, 5,0 wt. % of sodium nitrite, both having particle size lower than 10 micrometers, 6,3 wt. % of 1,3-benzodiazole and 1,5 wt. % of 5-methyl-1H-benzotriazole and 82,2 wt. % of the same low density polyethylene as in Example 1 was prepared, according to procedure described also in Example 1, pelletised masterbatch A2.

From the mixture containing 4,0 wt. % of sodium benzoate, 4,0 wt. % of sodium nitrite, 5,0 wt. % of 1,3-benzodiazole, and 1,2 wt. % of 5-methyl-1H-benzotriazole and 18 wt. % of amorphous silicium oxide having pore volume 1,6 ml/g, mean particle sine 2 micrometers and pH value of 5% water suspension 6,0 and 67,8 wt. % of the same low density polyethylene as in Example 1 was prepared, according to procedure described in Example 1, pelletised masterbatch B2.

Each of both masterbatches was in the amount of 6,0 wt. % homogeneously mixed with linear polyethylene having melt flow index 1,0 g/10 min and density 920 kg/m$^3$. Each of these mixtures was used for the production of the inner layer forming ⅔ of the twin layer film. Outer layer was formed by linear polyethylene having melt flow index 1,2 g/10 min and density 932 kg/m$^3$. Total thickness of each of both films was 62 micrometers. Tubular film extrusion technology using Alpine production line equipped with two extruders having 35 and 50 m in diameter, respectively, at the melt temperature range of 155–175° C., was employed. The film without addition of silicium oxide denoted as A2F has shown after 7 days of storage at room temperature slight exudation of inhibitors on the surface while the film containing silicium oxide and marked as B2F has not shown, even after 2 months of storage under the same conditions, any signs of surface changes.

Anticorrosive protection of films A2F, B2F and the film without any anticorrosive inhibitors (C2F film) was determined according to DIN 50017, KFW method, as it is described in Example 1. All films had the same thickness.

In case of the A2F film the steel test specimens nave shown signs of corrosion after 48 cycles and aluminum surface darkening after 42 cycles.

The testing of the B2F film was interrupted after 58 cycles without any corrosion marks on steel and aluminum test specimens while the first corrosion marks of test specimens protected by the C2F film appeared on steel after 8 cycles and on aluminum after 7 cycles.

Example 3

From the mixture comprising 8,0 wt. % of sodium benzoate, 3,8 wt. % of 1,3-benzodiazole and 1.6 wt. % of 1H-bezotriazole and 86,6 wt. % of the same low density polyethylene as in Example 1 was prepared pelletised masterbatch by the procedure described also in Example 1 which was marked A3. The masterbatch of amorphous silicium oxide in the same low density polyethylene was prepared on the equipment and by the procedure described in Example 1. Amorphous silicium oxide having mean particle size 2,5 micrometers, pore volume 1,25 ml/g and pH value of 5% water suspension 7.0 was used for the masterbatch production, the silicium oxide concentration was 20 wt. %.

To the mixture comprising 75 wt. % of low density polyethylene having melt flow index 2,0 g/10 min and 25 wt. % of EVA copolymer containing 18 wt. % of vinylacetate and having melt flow index 1,7 g/10 min was in one case added 6 wt. % of the masterbatch A3 and in the other case 4 wt. % of the masterbatch A3 and 4 wt. % of the above described silicium oxide masterbatch.

Films 100 micrometers thick were in all cases prepared by the procedure described in Example 1 and were marked as A3F, B3F and the noninhibited one as C3F. Corrosive protection was again tested according to DIN 50017, KFW method described also in Example 1.

In case when the A3F film was used for protecting test specimens the corrosion stains appeared on steel after 142 cycles and on aluminum after 122 cycles. The test of the B3F film was interrupted after 210 cycles without any visible signs of corrosion either on steel or aluminum test specimens. Corrosive damage of steel and aluminum protected by the C3F film was observed after 12 and 9 cycles, respectively.

Industrial Utilization

Anticorrosive plastics packaging materials comprising synergistic mixtures of contact-vapour phase inhibitors of corrosion can be used for protection against corrosion of all articles made of steel and aluminum, particularly for temporary protection of machinery articles during transportation and storage. The anticorrosive plastics packaging materials described here are applied in the form of all kinds of packaging films, packaging products made from films such as sacks, bags etc. or in the form of suitable containers.

What is claimed is:

1. Anticorrosive plastic packaging materials for protecting an article containing iron, aluminum and alloys of these metals, comprising synergistic mixture of contact-vapour phase inhibitors composed of 0.01–2.00 wt. % of salt or salts selected from salts of ammonium, alkali metals and alkaline earth-metals derived from benzoic acid and/or nitrous acid and 0.001–1.5 wt. % of 1,3-benzodiazole $C_7H_6N_2$ and/or its 1-methyl derivative and 0.001–1 wt. % of 1H-benzotriazole and/or its methyl derivative of the general formula

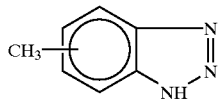

0.01–4 wt. % of amorphous silicium oxide having mean particle size of 1–20 micrometers, pore volume 0.4–2.5 ml/g and pH value in a 5% water suspension in the range of 4.0–8.0 and the rest is formed by plastic material.

2. The anticorrosive plastic packaging materials as claimed in claim 1 in which as a plastic material is used polyethylene and copolymers of ethylene with higher alpha olefins $C_4$–$C_8$ in the 860–967 kg/m$^3$ density range, copolymers of ethylene with vinylacetate or with $C_1$–$C_4$ alkylesters of acrylic or methacrylic acid where the content of comonomer is in the range of 0.5–40 wt. %, polypropylene, copolymers of propylene with ethylene and/or with higher $C_4$–$C_8$ alpha olefins wherein the comonomer content is 0.1–10 wt. %, or their mixtures.

3. The anticorrosive plastic packaging material as claimed in claim 1 being of mono or multilayer construction wherein the synergistic mixture of contact-vapour phase inhibitors is added either to the layer or layers closer to the article.

4. The anticorrosive plastic packaging materials as claimed in claim 1 being in the form of films or packaging products made of film or container and/or porous emittors which are placed together with the article into another packaging product.

* * * * *